United States Patent [19]

Szekely

[11] 3,980,742

[45] Sept. 14, 1976

[54] PROTECTION FOR EXTERNALLY HEATED CAST IRON VESSEL USED TO CONTAIN A REACTIVE MOLTEN METAL

[75] Inventor: Andrew Geza Szekely, Yorktown Heights, N.Y.

[73] Assignee: Union Carbide Corporation, New York, N.Y.

[22] Filed: Dec. 23, 1974

[21] Appl. No.: 536,954

Related U.S. Application Data

[60] Continuation-in-part of Ser. No. 323,785, Jan. 15, 1973, Pat. No. 3,870,511, which is a division of Ser. No. 211,950, Dec. 27, 1971, Pat. No. 3,743,263.

[52] U.S. Cl. ..... 264/30; 75/68 R; 75/95

[51] Int. Cl.[2] ..... F27D 1/16; C22B 21/06

[58] Field of Search ..... 264/30; 75/95, 68 R

[56] References Cited

UNITED STATES PATENTS 3,537,987 11/1970 Copeland ..... 75/68 R

*Primary Examiner*—Donald J. Arnold
*Assistant Examiner*—John Parrish
*Attorney, Agent, or Firm*—Saul R. Bresch

[57] ABSTRACT

An externally heated cast iron vessel, intended for containing a reactive molten metal, such as aluminum, is made resistant to attack by the molten metal, thereby increasing its useful service life and minimizing contamination of the melt, by lining the inside of the cast iron shell with a plurality of inert self-supporting, refractory plates, of for example, graphite, in such manner that the plates are free to move along their joints as well as relative to the shell upon thermal expansion, and permitting the molten metal to penetrate behind the lining through the joints and crevices therein opened by thermal expansion, thereby producing a refractory layer, in situ in the space between said lining and the inside surface of said cast iron shell, comprising a solid ($FeAl_3$) reaction product of iron and said molten metal.

6 Claims, 4 Drawing Figures

PROTECTION FOR EXTERNALLY HEATED CAST IRON VESSEL USED TO CONTAIN A REACTIVE MOLTEN METAL

This invention is a continuation-in-part of my application Ser. No. 323,785 filed Jan. 15, 1973, now U.S. Pat. No. 3,870,511, issued Mar. 11, 1975 which in turn is a division of Ser. No. 211,950 filed Dec. 27, 1971, now U.S. Pat. No. 3,743,263 issued July 3, 1973.

BACKGROUND

The present invention relates to a process for making an externally heated cast iron vessel intended for containing reactive molten metals, such as aluminum, resistant to attack by the molten metal; thereby increasing the useful service life of the vessel and minimizing contamination of the melt. The present invention also relates to the vessel thus produced.

In refining molten aluminum and other reactive metals, it is often desirable to use a vessel which is externally heated. Cast iron vessels are desirable because they have high thermal conductivity, can be cast in any desired shape and have a relatively low coefficient of thermal expansion. The problem, however, with cast iron is that it is corroded by molten aluminum. It is well known in the art that aluminum is a powerful solvent in its molten state, and that consequently care must be exercised in selecting materials with which it will come in contact during various processing steps such as melting, alloying, degassing, fluxing, filtration, transfer and casting. Improper selection of such material may cause contamination of the melt by reduction or solution of the container as well as deterioration of the container. It is normal commercial practice therefore to coat cast iorn objects which are to be used in contact with molten aluminum, such as with, for example, a wash of red mud, zirconium silicate, mica, iron oxide or titanium oxide. Sodium silicate may be added to the wash coating to improve its adherence to the cast iron. Such coatings are generally applied by brushing or spraying on to these portions of cast iron surface which will come in contact with the melt. However, these coatings wear off easily. The problem of the limited service life for externally heated cast iron vessels used for containing molten aluminum has not been satisfactorily solved by the prior art.

OBJECTS

It is therefore an object of this invention to provide a process for producing an externally heated cast iron vessel for continuous use with reactive molten metals such as aluminum which has long service life and which causes minimum contamination of the molten metal with iron.

It is another object of this invention to provide an externally heated cast iron vessel having improved service life, which is able to contain reactive molten metal, such as aluminum without contaminating the melt.

SUMMARY

The above and other objects which will be apparent to those skilled in the art are achieved by the present invention, one aspect of which comprises:

a process for making a vessel, comprised of an externally heated cast iron shell, resistant to attack by reactive molten metal contained therein, comprising the steps of:

a. lining the inside surface of said shell with a plurality of self-supporting, refractory plates which are inert with respect to said molten metal, in such manner that said plates are free to move along their joints relative to each other, as well as relative to the inner surface of said shell, upon thermal expansion of said vessel, b. filling the vessel with said reactive molten metal, c. maintaining the temperature of said vessel at a value at least equal to the melting point of said molten metal by externally heating said vessel, d. permitting said molten metal to penetrate behind said lining through the joints and crevices therein opened by thermal expansion, and thereby e. producing a refractory layer, in situ in the space between said lining and the inside surface of said cast iron shell, comprising a solid reaction product of iron and said molten metal, thereby preventing further direct contact between the molten metal in the vessel and any fresh cast iron surface of said shell.

Although the process and apparatus described above are particularly suitable where the molten metal is aluminum, the invention is also applicable to other reactive molten metals, such as zinc and tin. It is to be understood that the term, aluminum, as used in the present specification and claims, is intended to include the alloys of aluminum as well as pure aluminum.

The term plate, as used herein is not meant to be restricted to flat plates of, for example, graphite, but rather is intended to include machined or even cast component parts of any refractory material which is inert toward the molten metal. The term, plate, is also meant to distinguish the structure of the lining from monolithic or unitary structures.

Another aspect of the present invention comprises: an externally heated vessel for containing reactive molten metal comprising in combination:

a. a shell of cast iron, provided with b. a lining comprised of a plurality of self-supporting, refractory plates on the inside surface of said shell which are inert with respect to said molten metal, said plates being free to move along their joints relative to each other, as well as relative to the inner surface of said shell, upon thermal expansion of said vessel, and c. a refractory layer comprising a solid reaction product of iron and said molten metal produced in situ in the space between said lining and the inside surface of said shell.

If the vessel is intended for use with molten aluminum, then it is preferably made of grey cast iron, containing from about 0.2 – 1.5% chromium, and the lining is then preferably made from a plurality of self-supporting graphite plates.

DRAWINGS

DETAILED DESCRIPTION

Figure 1:
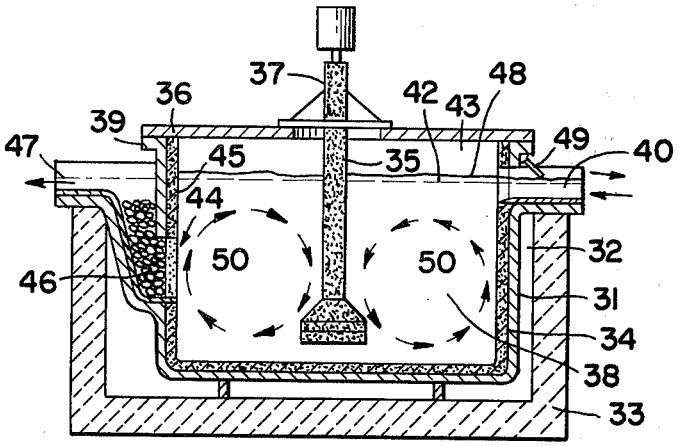
FIG. 1 is a schematic side view in cross-section of a vessel for containing molten aluminum, illustrating a preferred embodiment of the present invention.

FIG. 1 illustrates the aluminum refining system, disclosed in greater detail (as FIG. 3) in the aforementioned parent applications, the entire disclosures of which are incorporated herein by reference. The vessel of FIG. 1 comprises a cast iron shell 31 which is maintained at its operating temperature by conventional heating means located in well 32, and an outer refractory shell 33 for insulation against heat loss. The inner surface of the cast iron shell 31 is lined with graphite 34 or other refractory material which is inert to molten aluminum. Shell 31 is provided with a cover 36 which rests upon flange 39. Metal 38 enters the vessel through inlet port 40. Inside the vessel metal 38 is sparged and agitated by the action of inert gas injected into the melt through the rotating gas injector 35. Arrows 50 show the overall circulation pattern of the molten aluminum in the vessel caused by the rotating gas injector. The refined molten metal leaves the vessel through discharge port 44 situated below the metal surface 42 in wall 45. The metal passes through well 46 and leaves the refining system through exit trough 47 to a casting station. The graphite lining 34, in accordance with the present invention, consists of a plurality of graphite plates, which upon being heated to operating temperature will have sufficient spaces between adjoining plates to permit the metal 38 to penetrate behind the plates, forming a thin film of molten aluminum which on coming in contact with the cast iron shell 31 will form the $FeAl_3$ layer (not shown) as hereinafter described.

Figure 2:
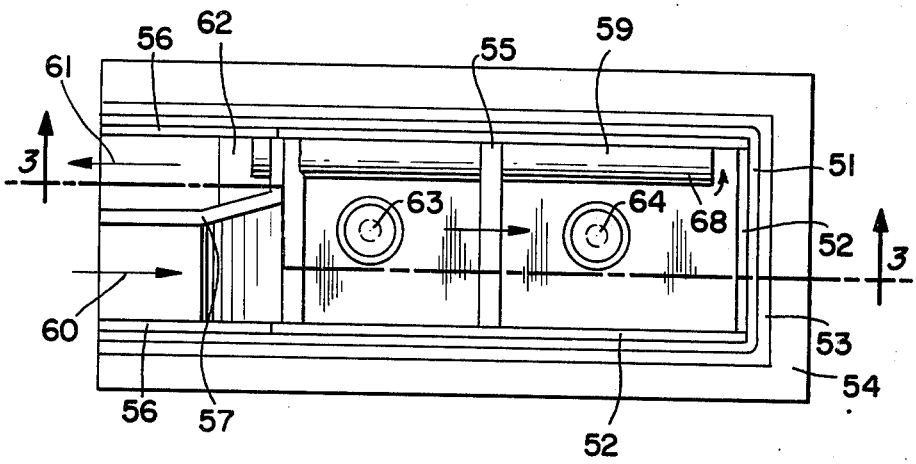
FIG. 2 is a top view in cross-section of a two-chambered aluminum refining vessel, illustrating another preferred embodiment of the present invention.
Figure 3:
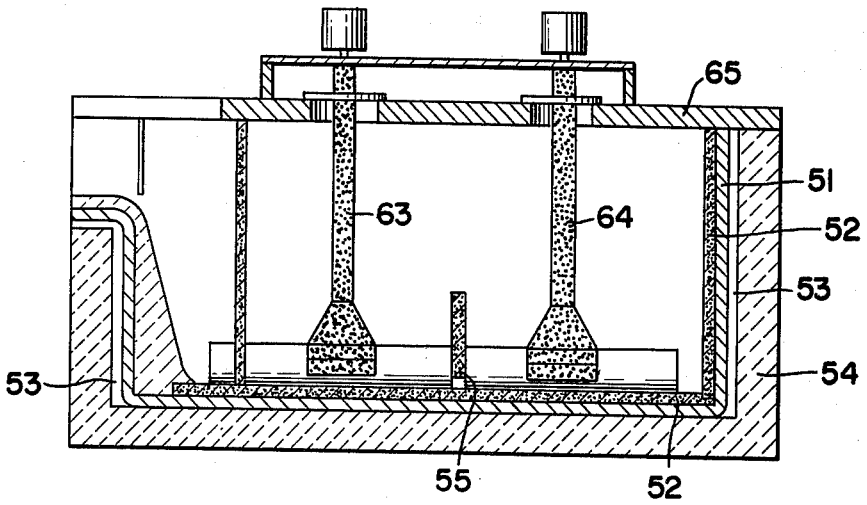
FIG. 3 is a schematic side view in cross-section taken along line 3—3 of FIG. 2.

FIGS. 2 and 3 disclose a two-chambered vessel comprised of a cast iron shell 51 lined on the inside with a plurality of graphite plates 52 and silicon carbide plates 56. Separate plates form the bottom and the side walls of the lining. The outside of the cast iron shell 51 is surrounded with a heating chamber 53 which may contain any conventional heating means such as, for example, electric coils. The heating chamber 53 is in turn surrounded with refractory insulation 54. Baffle plate 55 which separates the chambers is likewise made of a graphite plate. The direction of the flow of molten aluminum is shown by the arrows, arrow 60 showing the inlet section and arrow 61 the exit from well 62 which is preferably made of a plurality of silicon carbide plates 56 and 57. Rotating gas injectors 63 and 64, respectively, are mounted in the cover 65 of the vessel. Metal return pipe 68 is likewise of graphite.

Figure 4:
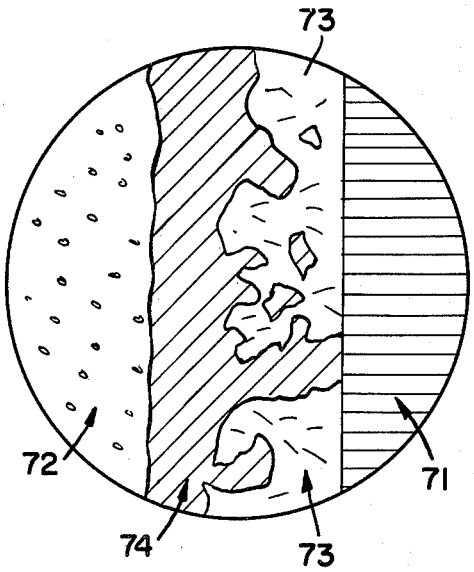
FIG. 4 is a schematic representation of an enlargement of the wall of either FIG. 1 or FIG. 2, illustrating the refractory layer formed in situ between the graphite lining and the cast iron shell.

FIG. 4 is a schematic representation of an enlargement of a segment of the wall of either FIG. 1 or FIG. 2 illustrating the cast iron shell 72, graphite plate 71 and therebetween the refractory lining formed in place, comprising the iron-saturated molten aluminum film 73 containing the precipitated $FeAl_3$ phase 74 which covers the surface of the cast iron shell 72. The small scale of FIGS. 1 and 2 prevents this layer from being shown in those Figures.

When assembling the vessel, the graphite plates are placed within the cast iron shell at room temperature, and fit as closely as possible to each other, as well as to the wall of the shell. After assembly of the graphite plates, all cracks or spaces between abutting plates are cemented with graphite cement. However, when the vessel is heated to its intended operating temperature (about 700°C for aluminum) these joints open up due to the differential thermal expansion between the cast iron and the graphite so that when the molten aluminum is introduced into the vessel, it will penetrate through these crevices in the lining and fill the space between the casting and the lining. On heating from room temperature to 700°C, graphite expands only about 12% as much as iron along the grain, and about 27% as much as iron across the grain. In addition to graphite, plates of silicon carbide or precast forms of either material may also be used. These plates may simply be cut to fit snguly into the shell or may be keyed or grooved to interlock.

Preferably the vessel is heated to its desired service temperature (e.g. to molten aluminum temperature) before the aluminum is introduced into the vessel. During heating of the vessel, the cast iron shell and the plates which make up the inert lining expand. Thermal expansion of the lining is unrestricted, that is, the plates are free to move relative to each other, as well as to the cast iron surface. The expanding components of the lining are permitted to move along their joints or abutting surfaces, that is along lines predetermined by design. This freedom of movement and the higher thermal expansion of cast iron prevents random checks from being produced in the lining at places other than joints or the abutting surfaces of the plates during thermal expansion of the vessel.

A very small quantity of the molten aluminum introduced into the heated vessel is permitted to come in contact with the cast iron surface by penetration through the crevices opened up along the joints of the plate lining by their thermal expansion. The width of these crevices may be minimized during installation of the lining at room temperature by matching the plates of the lining to each other as accurately as possible. In the case of graphite plates, a light application of graphite cement on the abutting surfaces is advantageous for establishing a tighter fit. Reduction of clearances between the plates, however, cannot be carried so far as to prevent their relative movement. The purpose of minimizing clearance between the plates is to prevent the crevices at the joints from growing too wide on thermal expansion. Contrary to expectations and the teachings of the prior art, this seepage of the reactive metal to the cast iron surface initiates the process, which under controlled conditions, ultimately inhibits the corrosion of the cast iron by molten aluminum, and by so doing leads to unexpectedly long vessel life.

When the molten aluminum behind the lining contacts the cast iron surface, it dissolves some iron from the cast iron matrix. Since the volume of the aluminum which penetrates behind a well-fitting lining is very small, compared to the area of contact with the cast iron, the iron dissolves into what can be pictured as a thin molten aluminum film, sandwiched between an externally heated cast iron wall and an inert graphite lining. The high temperature and the extent of contact area between the cast iron shell and the aluminum promotes rapid solution of the cast iron until the saturation limit is reached. The saturation concentration of iron in aluminum is a function of the temperature and of the composition of the aluminum alloy. In pure aluminum the saturation concentration of iron is approximated by the following equation, which is valid for the temperature range (655°–750°C) normally encountered in practice:

$$c = -13.8 + 0.024 \times t$$

where:

$c$ = the concentration of iron in aluminum (wt. –%), and $t$ = temperature of the aluminum (°C).

From this equation it can be calculated that at 700°C, the concentration of iron that will dissolve in aluminum is only about 3%. That is, a relatively small amount of iron can establish saturation in the molten aluminum film. At this saturation concentration, an intermetallic solid phase, corresponding to the stoichiometric formula $FeAl_3$ precipitates. This iron-aluminum phase is stable up to a decomposition temperature 1160°C, and since it is an iron rich phase, it starts to form on or in the vicinity of the cast iron surface. Precipitation of the $FeAl_3$ phase continues until all the aluminum layer enclosed behind the inert lining reaches saturation. At this point an equilibrium state is reached; no additional iron is dissolved and no additional $FeAl_3$ phase is formed. Further attack on the cast iron surface is now inhibited by the presence of the iron rich $FeAl_3$ intermetallic phase. A change in this equilibrium state is possible only if the iron concentration in the aluminum film drops below the limit. This could occur for example, if dissolved iron escapes from the iron saturated aluminum layer by diffusion through the crevices in the lining. If this were to happen, the $FeAl_3$ phase would assume a scavenging role by going into solution to re-establish equilibrium. In an overall balance, the rate of corrosion of the cast iron surface, following the initial formation of the protective intermellatic layer, is determined by the rate of mass transfer through the crevices in the graphite lining — possibly by the rate of diffusion of dissolved iron from the molten aluminum layer enclosed behind the lining. These rates, however, are very small so that the corrosion of the cast iron shell is extremely small, resulting in the unexpectedly long service life of the vessel.

The above described mechanism underscores the several important functions served by a self-supporting inert graphite plate lining. The inert lining forms a mechanical barrier against the chemical dissolution of the intermetallic refractory phase by the bulk of the molten aluminum metal contained in the vessel. It is advantageous to keep the size of the crevices small between the plates of the lining, since they represent the only avenues of communication between the iron-saturated layer behind the lining and the bulk of the metal in the vessel. The lining also prevents mechanical erosion of the protective $FeAl_3$ layer by the flow of the molten metal. This protection is particularly important when the metal in the vessel is in turbulent flow or vigorously stirred, as for example, during the refining process described in U.S. Pat. No. 3,743,263 previously referred to. Not directly related to the mechanism of formation of the refractory layer, but still of great practical importance, is the fact that the material of the self-supporting lining can be selected from materials, such as graphite or silicon carbide, which are not only truly inert to and not wetted by aluminum, but are also good thermal conductors. The present invention makes utilization of these materials possible in the form of relatively thin self-supporting plates. Consequently, large vessels can be lined with such materials without running into prohibitive costs.

Although the $FeAl_3$ phase can always be found in the refractory layer formed between the cast iron and the graphite lining, other phases may also be present when commercial aluminum alloys are processed. For example, in the case of silicon containing aluminum alloys, an intermetallic phase corresponding to a stoichiometric composition of $Fe_3SiAl_{12}$ precipitates at relatively low iron concentrations, if the molten metal film behind the inert lining becomes enriched with silicon above about 0.7 wt. –% silicon. This phase provides protection for the cast iron surface by essentially the same mechanism as $FeAl_3$. The decomposition temperature of this phase (860°C) is also significantly above the normal temperatures encountered in refining molten aluminum.

Besides the iron itself, the alloying elements of cast iron may also contribute to the formation of a protective refractory layer. For example, the silicon for the aforementioned intermetallic phase can be supplied by the cast iron, since cast iron commonly contains silicon. Another alloying element which forms an intermetallic phase with aluminum is chromium. At 700°C a solid phase $CrAl_7$ precipitates from molten aluminum if the concentration of chromium exceeds about 0.7 wt. –% chromium. The decomposition temperature of $CrAl_7$ is about 725°C.

EXAMPLE

A vessel as shown in FIGS. 2 and 3 was constructed of a cast iron shell containing 0.6% chromium and lined with 1⅛ inches thick graphite plates on the sides, and 2 inches thick graphite plates on the bottom. The metal inlet and outlet areas of the shell were lined with silicon carbide plates. The vessel was preheated to 700°C before being filled with molten aluminum. The vessel was externally heated by electric power, and the temperature of the aluminum was kept at about 700°C throughout. The melt was violently stirred by driven impellers and gas bubbles, since the vessle was used to carry out the aluminum refining process described in U.S. Pat. No. 3,743,263. Over a continuous period of 6 months of field testing under conditions of actual commercial operation, the graphite lining was not wetted, chemically attacked or eroded either by the aluminum or by the dross. Consequently, the vessel did not require periodic cleaning or repairs. This length of continuous operation under the turbulent flow conditions of molten aluminum is far in excess of the service life of externally heated cast iron vessels made by prior art techniques.

The advantages of a vessel made in accordance with the present invention are numerous. The present invention enables an externally heated cast iron vessel to have a significantly longer service life than was obtainable by the prior art. The molten metal in the vessel is not contaminated by the cast iron shell. The metal in the vessel may be in turbulent flow without causing damage to the protective layer. And heat transfer through the vessel wall is facilitated since all three components of the vessel walls, namely the cast iron shell, the intermetallic layer and the graphite lining are all good conductors of heat.

What is claimed is:

1. A process for making a vessel, comprised of an externally heated cast iron shell, resistant to attack by reactive molten metal selected from the group consisting of aluminum, tin, and zinc contained therein, comprising the steps of:

a. lining the inside surface of said shell with a plurality of self-supporting, refractory plates which are inert with respect to said molten metal, in such manner that said plates are free to move along their joints relative to each other, as well as relative to the inner surface of said shell, upon thermal expansion of said vessel, b. filling the vessel with said reactive molten metal, c. maintainig the temperature of said vessel at about the melting point of said molten metal by externally heating said vessel, d. permitting said molten metal to penetrate behind said lining through the joints and crevices therein opened by thermal expansion, and thereby e. producing a refractory layer, in situ in the space between said lining and the inside surface of said cast iron shell, comprising a solid reaction product of iron and said molten metal, thereby preventing further direct contact between the molten metal in the vessel and any fresh cast iron surface of said shell.

2. The process of claim 1 wherein said molten metal is aluminum.

3. The process of claim 1 wherein the vessel is preheated to a temperature substantially equal to the melting point of said molten metal before the vessel is filled with said molten metal.

4. The process of claim 2 wherein said refractory layer comprises $FeAl_3$.

5. The process of claim 2 wherein said cast iron shell is grey cast iron, and wherein said refractory plates are selected from the group consisting of graphite and silicon carbide plates.

6. The process of claim 5 wherein the vessel is preheated to a temperature substantially equal to the melting point of said molten metal before the vessel is filled with said molten metal.

* * * * *

UNITED STATES PATENT OFFICE
CERTIFICATE OF CORRECTION

Patent No. 3,980,742 Issue Date September 14, 1976

Inventor(s) Andrew Geza Szekely

It is certified that error appears in the above-identified patent and that said Letters Patent are hereby corrected as shown below:

Column 1, line 37, change "iorn" to --iron--; column 4, line 26, change "checks" to --cracks--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*